US011319043B2

(12) United States Patent
Lin

(10) Patent No.: US 11,319,043 B2
(45) Date of Patent: May 3, 2022

(54) BUILT-IN PROPULSION SYSTEM

(71) Applicant: SOLAS SCIENCE & ENGINEERING CO., LTD., Taichung (TW)

(72) Inventor: Yeun-Junn Lin, Taichung (TW)

(73) Assignee: SOLAS SCIENCE & ENGINEERING CO., LTD., Taichung (TW)

( * ) Notice: Subject to any disclaimer, the term of this patent is extended or adjusted under 35 U.S.C. 154(b) by 71 days.

(21) Appl. No.: 16/881,939

(22) Filed: May 22, 2020

(65) Prior Publication Data

US 2021/0331775 A1 Oct. 28, 2021

(30) Foreign Application Priority Data

Apr. 22, 2020 (TW) ..... 109113473

(51) Int. Cl.
*B63H 5/16* (2006.01)

(52) U.S. Cl.
CPC ..... *B63H 5/165* (2013.01)

(58) Field of Classification Search
CPC . B63H 5/165; B63H 1/04; B63H 5/16; B63H 11/00; B63H 11/01; B63H 5/07
See application file for complete search history.

(56) References Cited

U.S. PATENT DOCUMENTS 3,082,732 A * 3/1963 Stallman ..... B63H 11/08 440/39
4,790,781 A * 12/1988 Takahashi ..... B63H 11/08 440/38
4,813,895 A * 3/1989 Takahashi ..... B63H 20/00 440/41
4,850,909 A * 7/1989 Hampton ..... B63H 11/01 440/46
4,872,858 A * 10/1989 Hasegawa ..... B63H 11/08 440/38

* cited by examiner

*Primary Examiner* — Anthony D Wiest
(74) *Attorney, Agent, or Firm* — Muncy, Geissler, Olds & Lowe, P.C.

(57) ABSTRACT

A built-in propulsion system includes an engine, a diversion unit with a diversion base and an exhaust pipe, and a propulsion unit. The diversion base is connected to the engine, having a water inlet, a water outlet, a diversion channel in communication between the water inlet and the water outlet, a shaft hole above the water inlet and an exhaust chamber behind the shaft hole. The exhaust pipe is fixed on the outer periphery surface of the diversion base in communication with the exhaust chamber. The propulsion unit includes a transmission shaft inserted through the shaft hole and connected to the engine, and an impeller located in the diversion channel and connected to the transmission shaft. The exhaust pipe is used to exhaust the exhaust gas of the engine to the outside of the diversion base to avoid the interference of the exhaust gas and the water flow.

7 Claims, 8 Drawing Sheets

BUILT-IN PROPULSION SYSTEM

BACKGROUND OF THE INVENTION

1. Field of the Invention

The present invention relates to ship propulsion systems, and more particularly to a built-in propulsion system.

2. Description of the Related Art

The general marine thruster mainly uses the engine to drive the propeller for high-speed operation. When the propeller is running at high speed, each blade will push the water flow backwards, and the reaction force generated when the water flow pushes back is used as the propulsion power of the hull, and the steering of the hull is controlled by the left and right deflection of the rudder.

Because the conventional propeller has a deep draught, the effective propulsion component generated by the rotation of the propeller when the boat is sailing is small and the propulsion efficiency is low. Secondly, the exhaust gas generated by the engine will be discharged through the shaft hole of the propeller hub, so that the water flow driven by the propeller and the exhaust gas generated by the engine easily interfere with each other at the water outlet to form a turbulent flow. As a result, the resistance of the propeller during operation becomes larger and the thrust applied to the hull is weakened, resulting in a reduction in propulsion efficiency. In addition, the propeller and the rudder are exposed at the bottom of the hull, which is easy to collide with foreign objects when the boat is sailing, or easy to entangle with foreign objects (such as plastic bags or fishing nets) during rotation to cause damage.

SUMMARY OF THE INVENTION

The present invention has been accomplished under the circumstances in view. It is the main object of the present invention to provide a built-in propulsion system, which can improve the propulsion efficiency.

To achieve this and other objects of the present invention, a built-in propulsion system comprises an engine, a diversion unit and a propulsion unit. The diversion unit comprises a diversion base and an exhaust pipe. The diversion base is located at a bottom end of the engine, comprising a water inlet located at a front end thereof, a water outlet located at an opposing rear end thereof, a diversion channel defined therein and having two opposite ends thereof respectively disposed in communication with the water inlet and the water outlet, a shaft hole, and an exhaust chamber. The shaft hole is located above the water inlet and communicated with the diversion channel. The exhaust chamber is located behind the shaft hole and fixed with a top end thereof on the outer periphery of the diversion base in communication with the exhaust chamber of the diversion base. The propulsion unit comprises a transmission shaft and an impeller connected to the transmission shaft. The transmission shaft is rotatably inserted through the shaft hole of the diversion base and connected to the engine. The impeller is located in the diversion channel of the diversion base above the water inlet of the diversion base. Thus, the power generated by the engine will drive the impeller to rotate through the transmission shaft.

It can be seen from the above that when the impeller rotates, the water flow is first drawn into the diversion channel. Then, after the rectification effect of the impeller, the water flow is ejected backward from the water outlet to advance the boat. During the operation of the engine, the exhaust gas generated by the engine will be concentrated in the exhaust chamber of the diversion base and then discharged from the exhaust pipe to the outside of the diversion base. This can effectively prevent the exhaust gas from interfering with the water flow through the diversion channel, thereby improving the propulsion efficiency.

Preferably, the water inlet has the opening thereof facing downward. The diversion unit further comprises a water inlet block located on a bottom surface of a front end of the diversion base below the water inlet. The water inlet block comprises a plurality of first diversion holes located on a front end thereof in communication with the water inlet, and a plurality of second diversion holes located on a bottom surface thereof in communication with the water inlet. With the setting of the first diversion holes and the second diversion holes, the water flow can be effectively guided into the diversion base through the water inlet block.

Preferably, the water inlet block comprises a plurality of arc-shaped deflectors arranged at intervals on the bottom surface thereof. With the setting of the arc-shaped deflectors, the water flow can be effectively guided from the second diversion holes into the diversion channel.

Preferably, the diversion base further comprises a ring wall surrounding the impeller so that the impeller can be completely covered. The arrangement of the ring wall not only can improve the water inlet efficiency, but also can make the impeller less harmful to fish, swimmers or divers near the bottom of the boat. Therefore, it can also be applied when the draft of the boat is shallow.

Preferably, the diversion unit further comprises a reverse deflector pivotally connected to the rear end of the diversion base and biasable up and down relative to the diversion base. When the reverse deflector is located above the water outlet, the water flow from the water outlet is directly ejected backward, making the boat forward. When the reverse deflector is located behind the water outlet, the water flow from the water outlet is changed by the reverse deflector to spray to the front, causing the boat to retreat.

Preferably, the reverse deflector comprises two lugs respectively located at opposing left and right sides thereof. The two lugs have a respective front end thereof respectively pivoted to the rear end of the diversion base. The diversion unit further comprises a rocker and a link. The rocker is pivoted back and forth on the outer peripheral surface of the diversion base. The link has a front end thereof pivoted on a bottom end of the rocker, and an opposing rear end thereof pivoted on a rear end of one lug of the reverse deflector. With the above technical features, when the rocker is driven by the power source, it can pull or push the reverse deflector through the link, so that the reverse deflector can be switched between the upper and lower positions.

Preferably, the diversion unit further comprises a tension spring. The tension spring has two opposite ends thereof respectively connected to the rocker and the reverse deflector, which can provide elastic force to help the link pull the reverse deflector from the second position to the first position.

Preferably, the exhaust pipe has a bottom end thereof open downward, which can surely prevent the exhaust gas of the engine from interfering with the water flow discharged from the water outlet.

The detailed structure, characteristics, assembly or use of the built-in propulsion system provided by the present invention will be described in the detailed description of the subsequent preferred embodiment. However, those with ordinary knowledge in the field of the present invention should be able to understand that these detailed descriptions and specific embodiments listed in the implementation of the present invention are only used to illustrate the present invention, not to limit the scope of the patent application of the present invention.

DETAILED DESCRIPTION OF THE INVENTION

Figure 1:
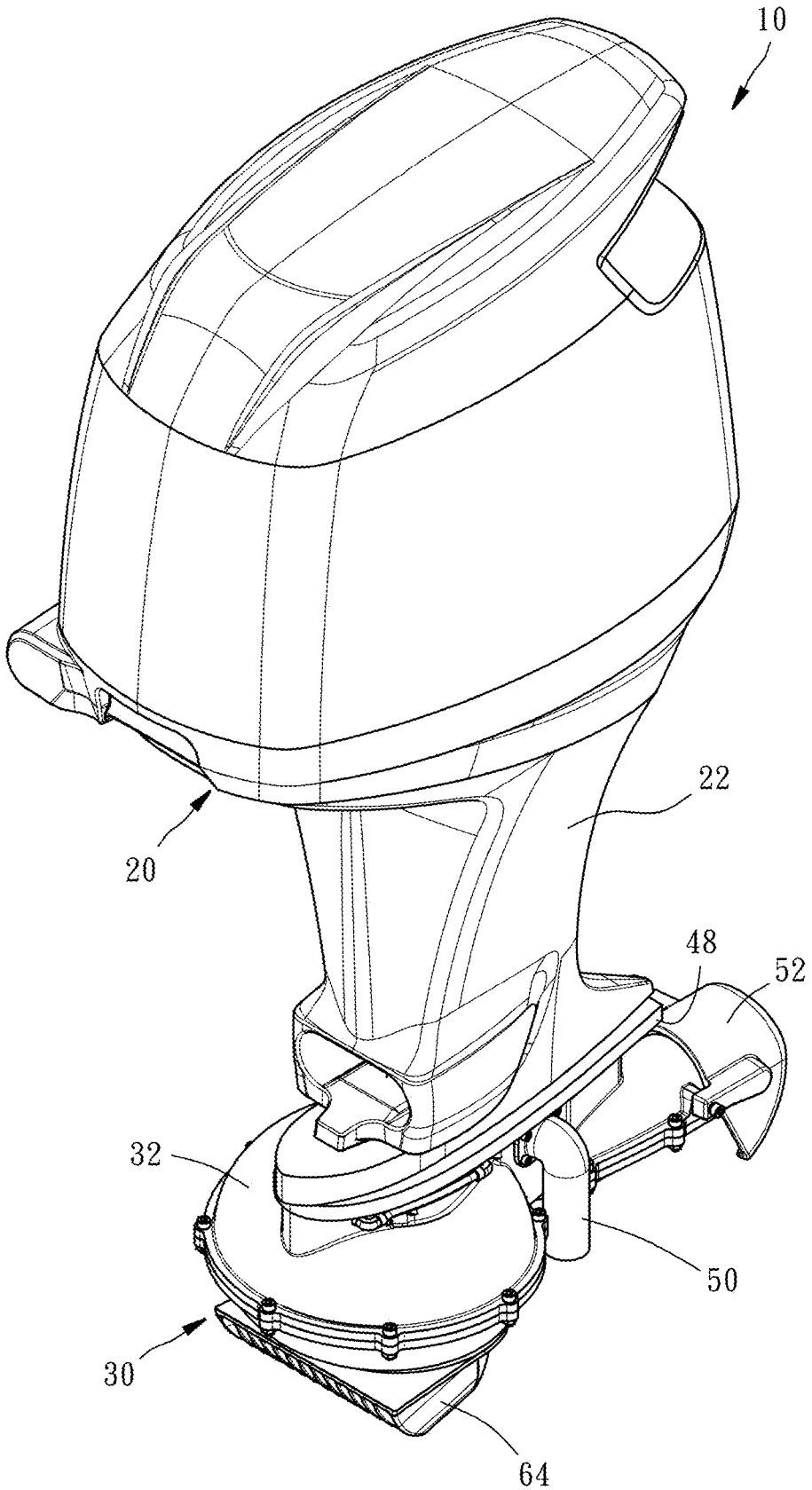
FIG. 1 is an oblique top elevational view of a built-in propulsion system in accordance with the present invention.

The applicant first states here that throughout the specification, including the preferred embodiment described below and the claims in the scope of patent application, the terms related to directionality are based on the directions in the drawings. Secondly, in the preferred embodiments and drawings to be described below, the same element numbers represent the same or similar elements or their structural features.

Referring to FIGS. 1-4, a built-in propulsion system 10 comprises an engine 20, a diversion unit 30, and a propulsion unit 72.

The engine 20 is a conventional technology, and its detailed structure and operating principle will not be described here.

Figure 3:
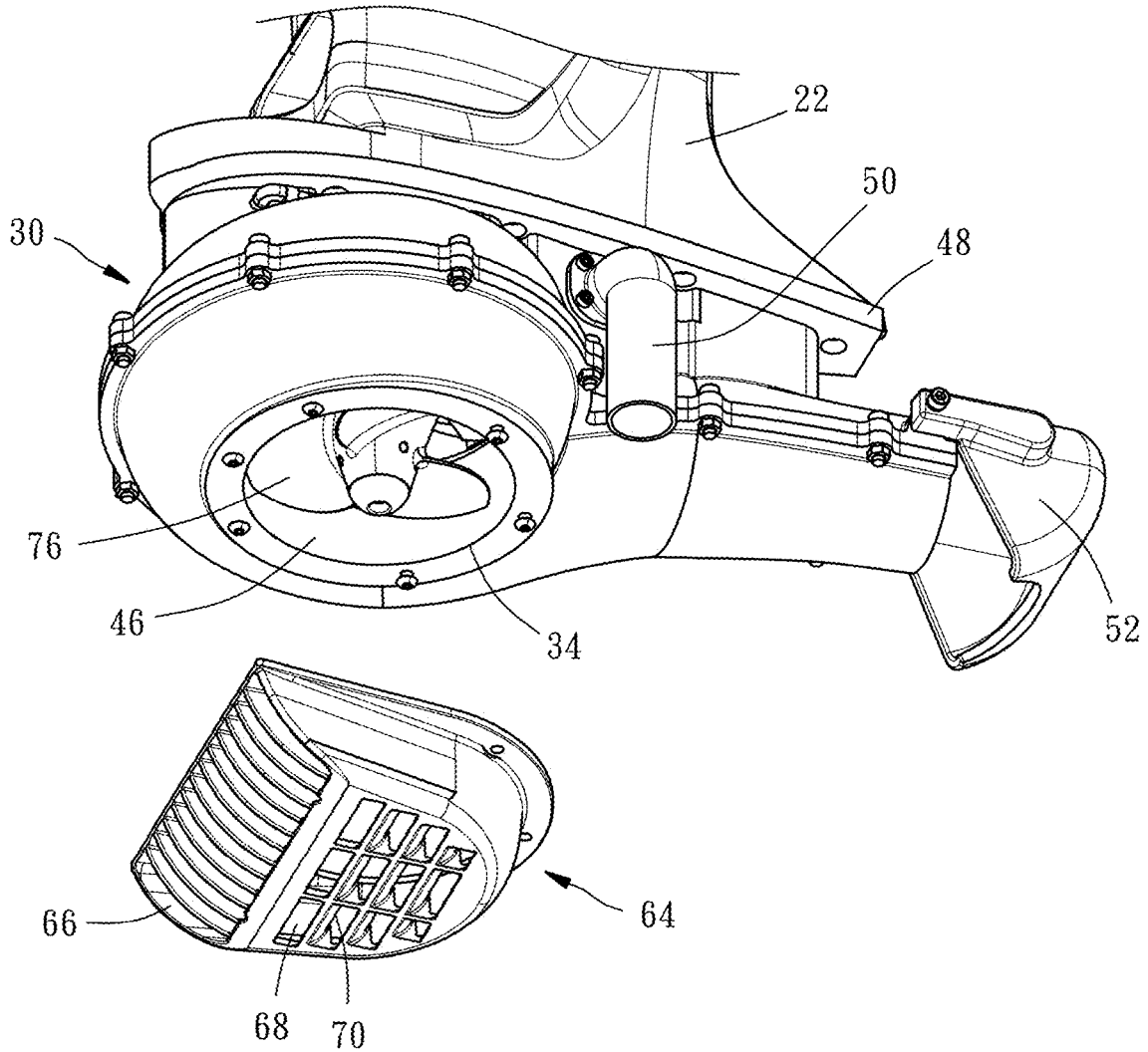
FIG. 3 is an exploded view of a part of the built-in propulsion system in accordance with the present invention.
Figure 4:
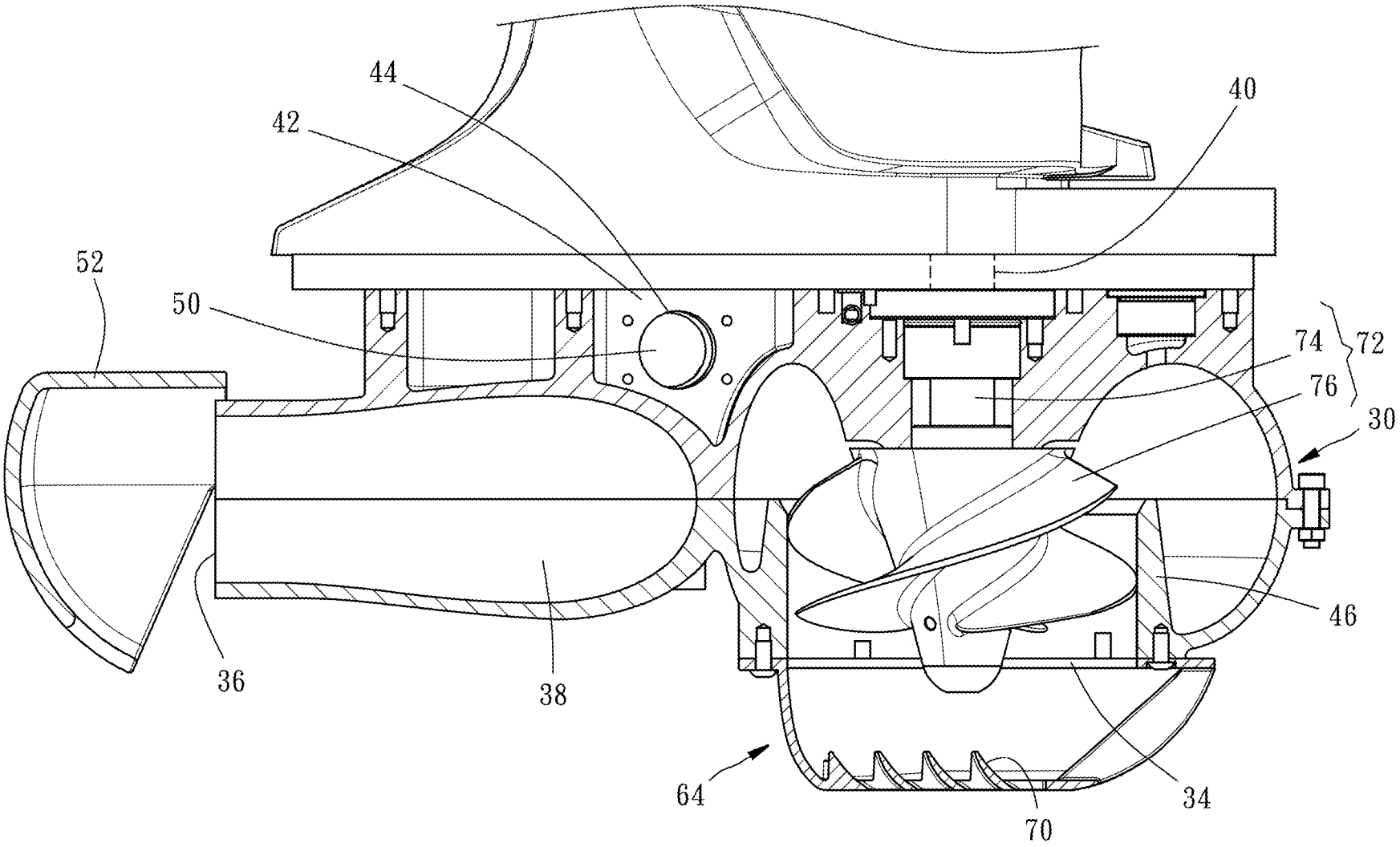
FIG. 4 is a sectional side view of a part of the built-in propulsion system in accordance with the present invention.
Figure 5:
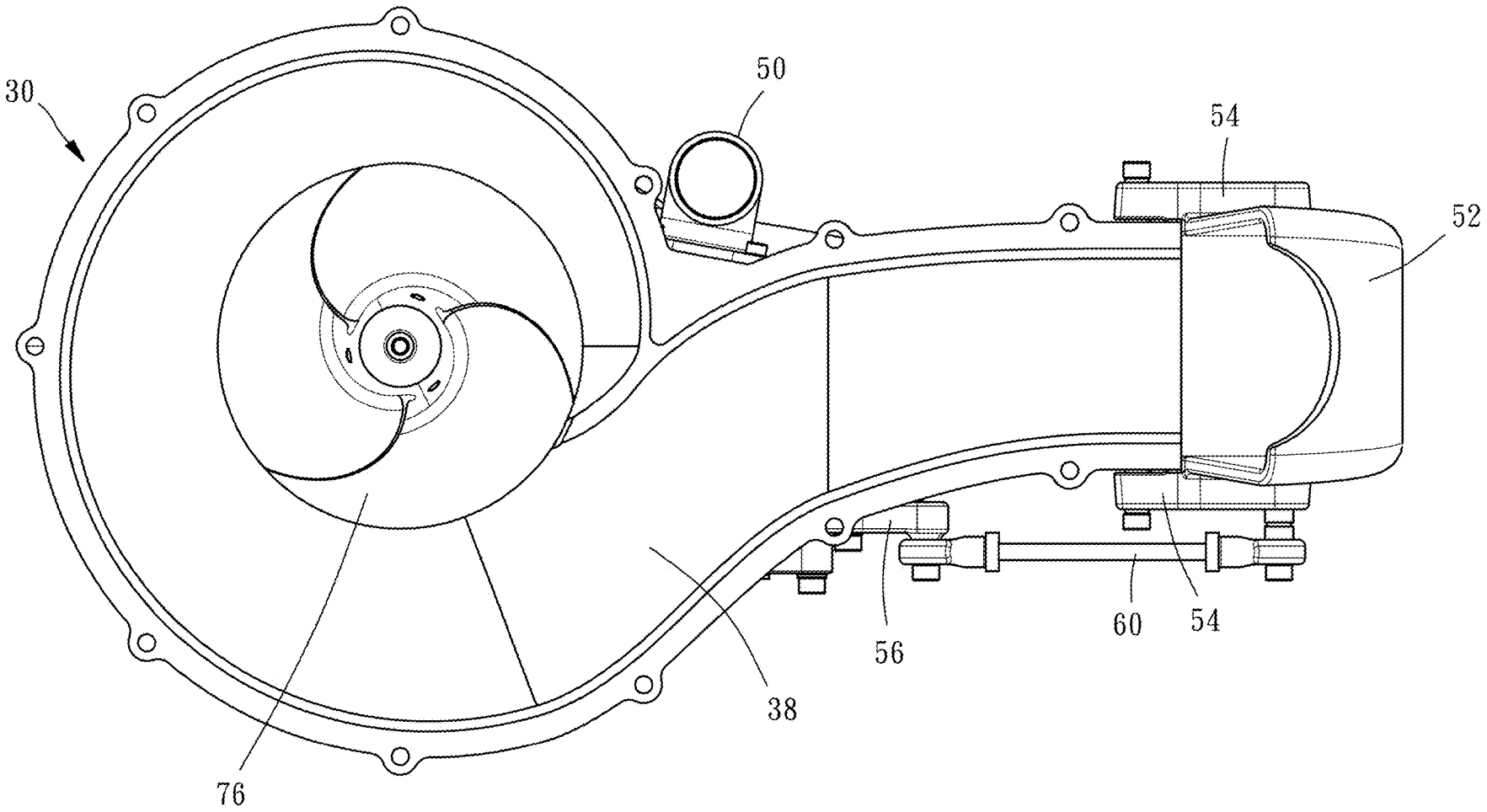
FIG. 5 is a sectional bottom view of a part of the built-in propulsion system in accordance with the present invention.
Figure 6:
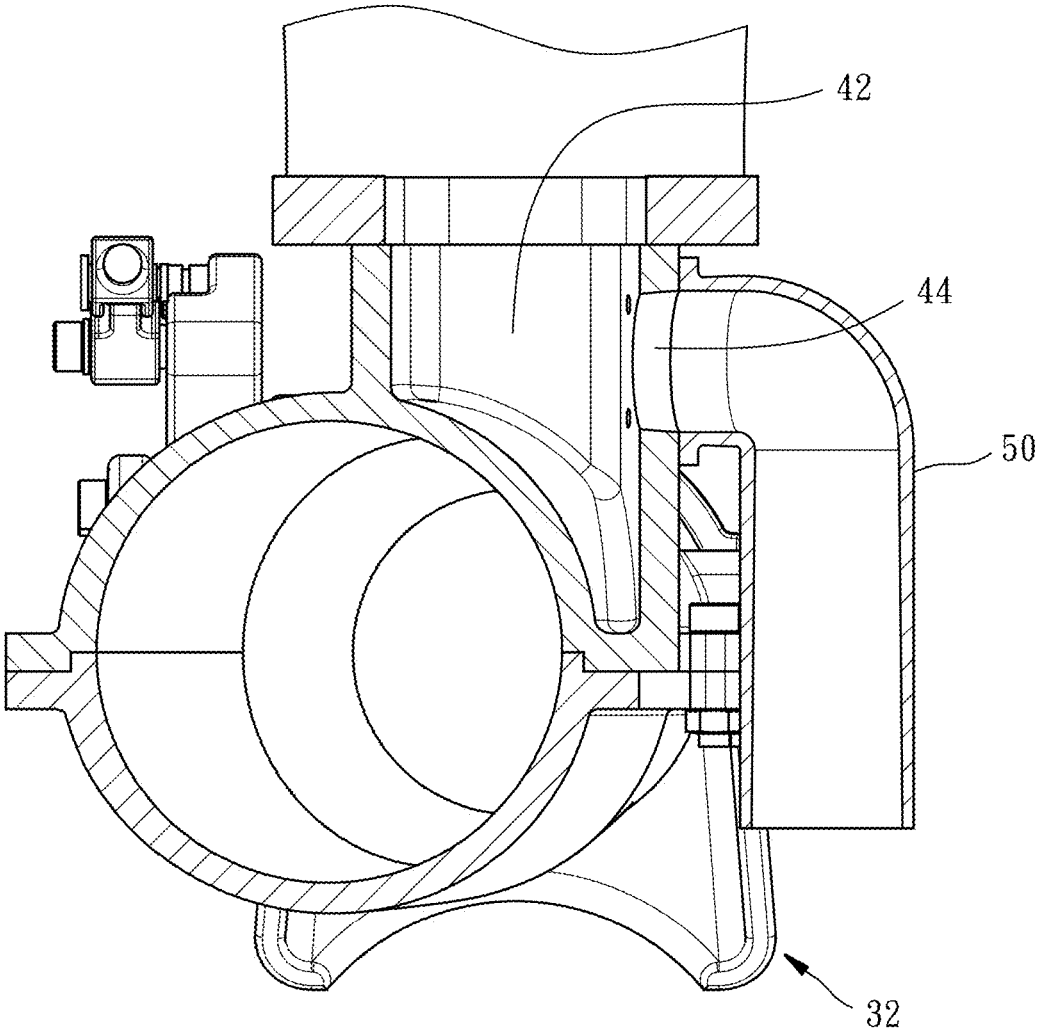
FIG. 6 is a sectional end view of a part of the built-in propulsion system in accordance with the present invention.

The diversion unit 30 comprises a diversion base 32, which is assembled to the bottom end of the housing 22 of the engine 20 through an adapter plate 48. As shown in FIG. 3 and FIG. 4, the diversion base 32 has a water inlet 34 located on a front end thereof and facing downward, a water outlet 36 located on an opposing rear end thereof and facing backward, and a diversion channel 38 defined therein and extending spirally. The diversion channel 38 has opposing front and rear ends thereof respectively connected to the water inlet 34 and the water outlet 36. As shown in FIG. 4, the diversion unit 30 further comprises a shaft hole 40 and an exhaust chamber 42. The shaft hole 40 is located above the water inlet 34 and communicates with the diversion channel 38. The exhaust chamber 42 is located behind the shaft hole 40 and communicates with the outside through an exhaust hole 44.

The diversion unit 30 further comprises an exhaust pipe 50. As shown in FIGS. 3-6, the exhaust pipe 50 has a top end thereof fixed to the outer surface of the diversion base 32 and connected to the exhaust chamber 42 of the diversion base 32 through the exhaust hole 44 of the diversion base 32, and an opposing bottom end thereof opened and facing downward. In this way, the exhaust gas generated by the engine 20 will first be concentrated in the exhaust chamber 42 and then discharged from exhaust pipe 50 to the outside of diversion base 32 to prevent the exhaust gas from interfering with the flow of water that flows through the diversion channel 38.

Figure 2:
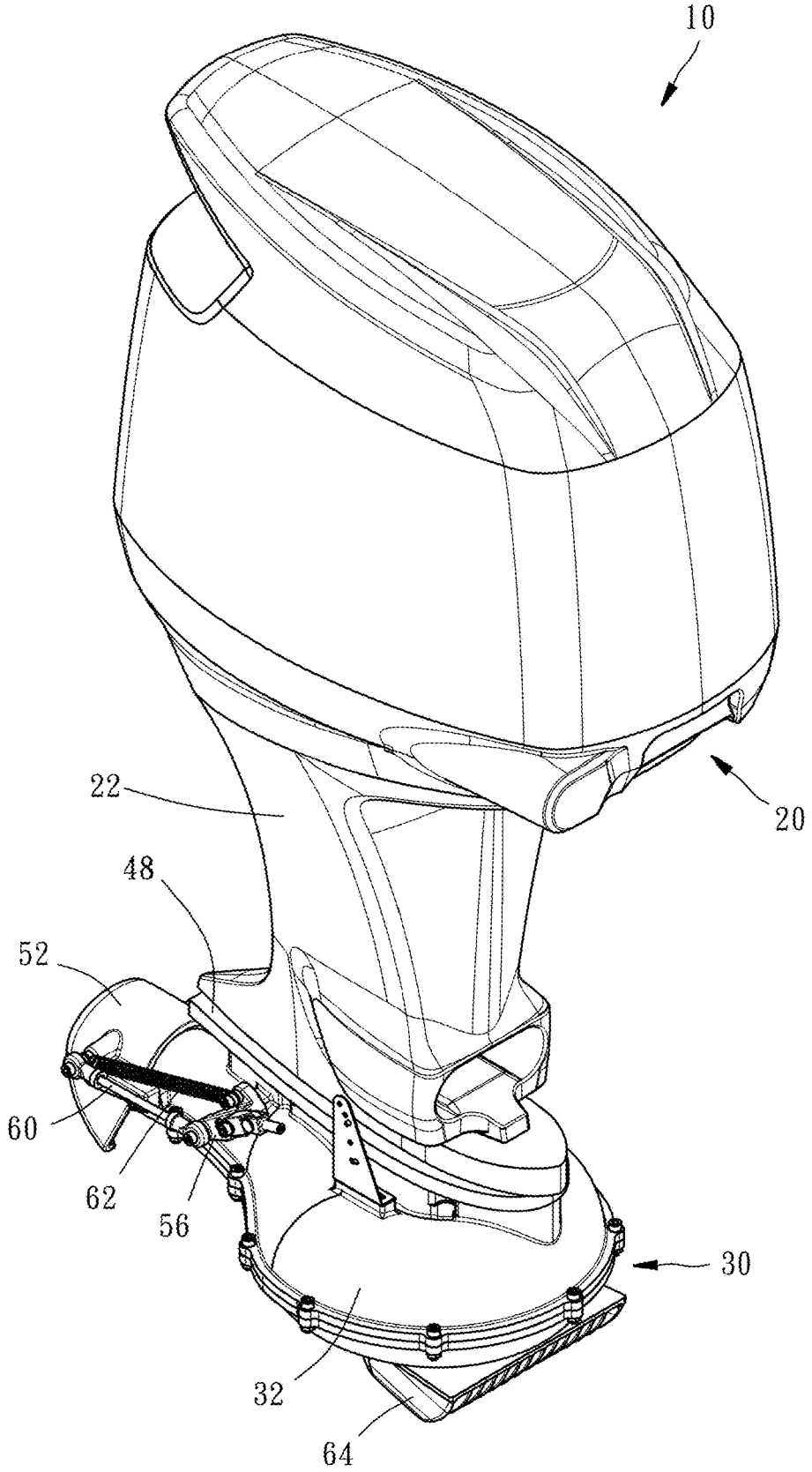
FIG. 2 corresponds to FIG. 1 when viewed from another angle.
Figure 7:
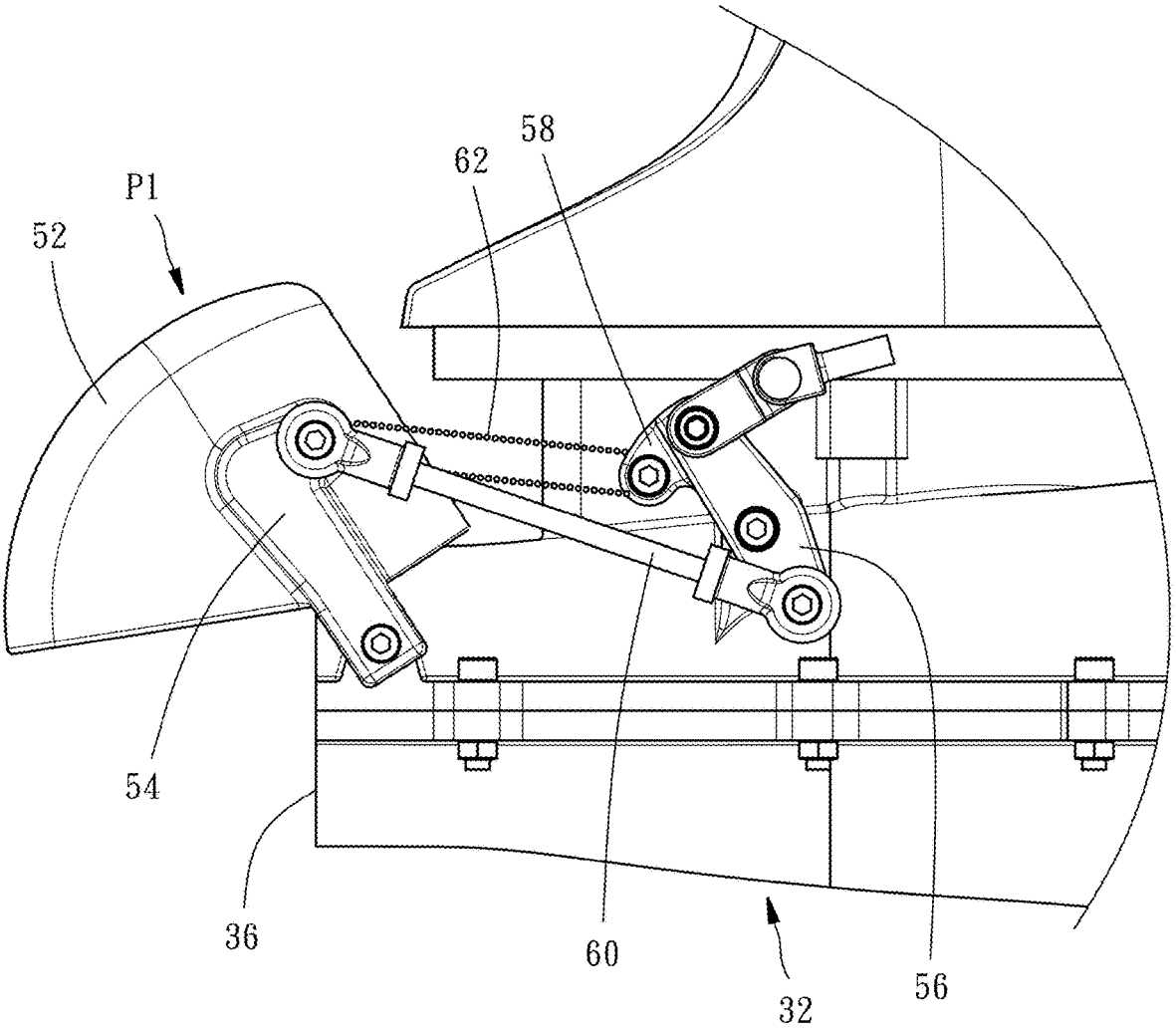
FIG. 7 is a sectional side view of a part of the present invention, mainly showing the reverse deflector disposed above the water outlet.
Figure 8:
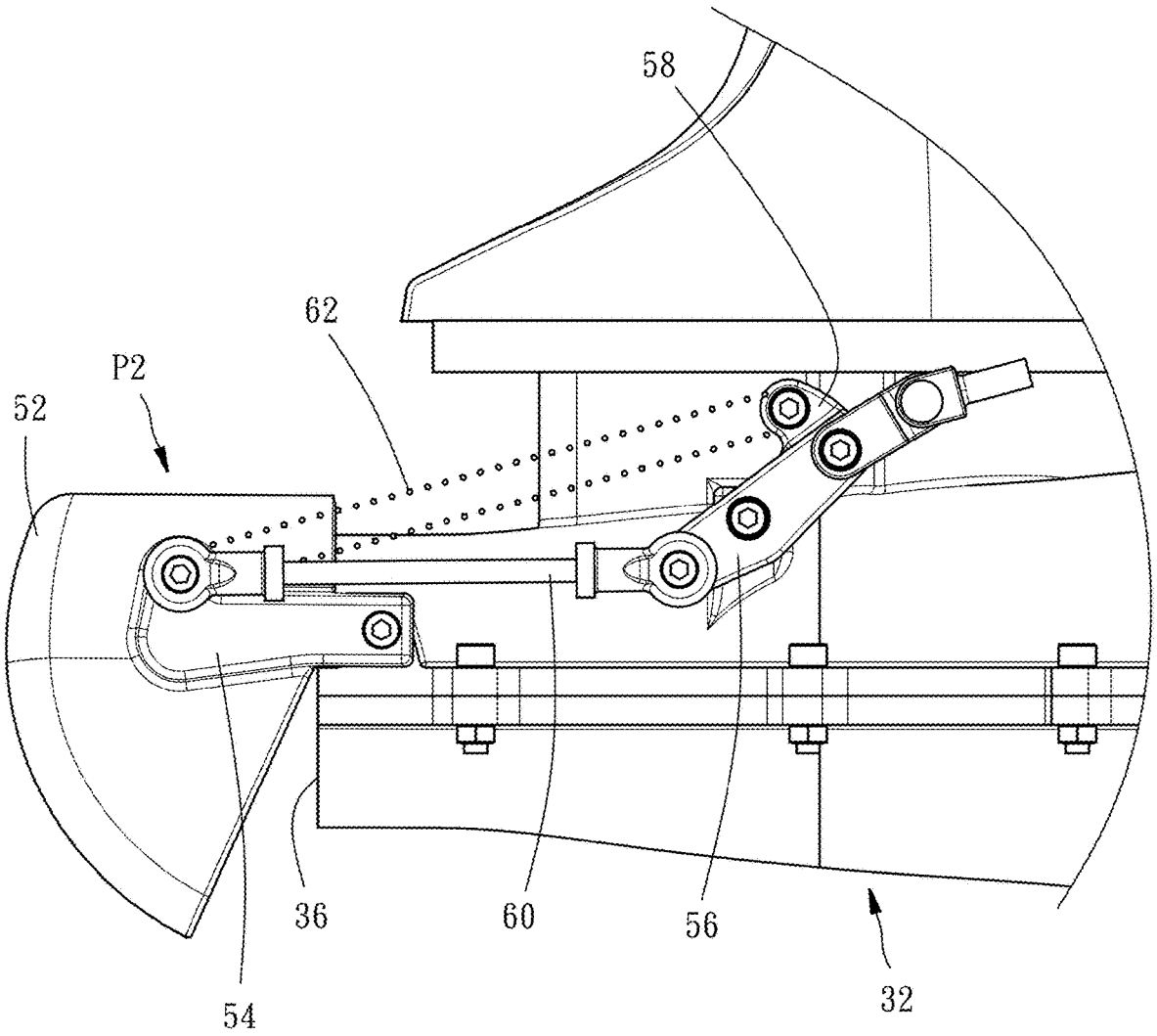
FIG. 8 is similar to FIG. 7, mainly showing the reverse deflector disposed behind the water outlet.

As shown in FIGS. 2, 7 and 8, the diversion unit 30 further comprises a reverse deflector 52, a rocker 56, a link 60 and a tension spring 62.

The reverse deflector 52 has a lug 54 located at each of opposing left and right sides thereof. The left and right two lugs 54 have a respective front end thereof respectively pivotally a rear end of the diversion base 32, so that the reverse deflector 52 can be swung relative to the diversion base 32 between a first position P1 shown in FIG. 7 and a second position P2 shown in FIG. 8. When the reverse deflector 52 is in the first position P1, the reverse deflector 52 is above water outlet 36. When the reverse deflector 52 is in the second position P1, the reverse deflector 52 is behind the water outlet 36. The rocker 56 is pivotally located on the outer surface of the diversion base 32 and can be driven forward and backward relative to the diversion base 32 by a power source (not shown). The link 60 has a front end thereof pivotally connected to a bottom end of the rocker 56 and an opposing rear end thereof pivotally connected to a rear end of the right side lug 54 of the reverse deflector 52. The tension spring 62 has opposing front and rear ends thereof respectively connected to a lug 58 of rocker 56 and the rear end of right side lug 54 of the reverse deflector 52, to provide elastic force to help the link 60 the pull reverse deflector 52 from the second position P2 to the first position P1.

As shown in FIGS. 1-3, the diversion unit 30 further comprises a water inlet block 64, which is assembled on a bottom surface of an opposing front end of the diversion base 32 below the water inlet 34. The water inlet block 64 has a plurality of first diversion holes 66 located on a front end thereof in communication with the water inlet 34 and arranged in a grid, and a plurality of second diversion holes 68 located on a bottom surface thereof and arranged in rows. In addition, as shown in FIG. 4, the water inlet block 64 has three arc-shaped deflectors 70 arranged at intervals on a bottom surface thereof to direct water passing through the first diversion holes 66 and the second diversion holes 68 to the water inlet 34 of the diversion base 32.

The propulsion unit 72 comprises a transmission shaft 74 and an impeller 76 connected to the transmission shaft 74. As shown in FIG. 3 and FIG. 4, the transmission shaft 74 is inserted through the shaft hole 40 of the diversion base 32 and connected to the engine 20. The impeller 76 is located in the diversion channel 38 of diversion base 32 above the water inlet 34 of the diversion base 32 and is surrounded by a ring wall 46 of the diversion base 32. In this way, the engine 20 can drive the impeller 76 to rotate through the transmission shaft 74.

It can be seen from the above that when the impeller 76 rotates, the water flow is first drawn into the water inlet block 64, and then guided from the water inlet block 64 to the diversion base 32. Then, after the rectification effect of the impeller 76, the water flow enters the diversion channel 38, and finally sprays backward from the water outlet 36, so that the water flow shows a low-pressure and large-flow jet state.

When the reverse deflector 52 is located at the first position P1 as shown in FIG. 7, since the reverse deflector 52 is located above the water outlet 36, the water jet from the water outlet 36 will be directly sprayed backward to advance the boat. When the reverse deflector 52 is located at the second position P2 as shown in FIG. 8, since the reverse deflector 52 is located behind the water outlet 36, the water jet from the water outlet 36 will be changed by the reverse deflector 52 to spray forward, causing the boat to retreat.

In summary, compared with the prior art, the built-in propulsion system 10 of the present invention has the following advantages:

1) In operation, the water flow is first drawn into the water inlet block 64, then guided from the water inlet block 64 to the diversion base 32, and finally after being rectified by the impeller 76, it is ejected backward from the water outlet 36, which is not easy to cause generation of eddy currents behind the stern. During the voyage, the exhaust gas generated by the engine 20 will be discharged from the exhaust pipe 50 to the outside of the diversion base 32. The two are not easy to interfere with each other, so it can improve propulsion efficiency and increase maneuverability.

2) Under the surrounding of the ring wall 46, on the one hand, the water flow can be effectively concentrated to improve the efficiency of water intake, on the other hand, the impeller 76 is less likely to harm fish, swimmers or divers near the bottom of the boat. It is also applicable when the draft is shallow.

3) The design of the water inlet block 64 can prevent various large debris (such as garbage, driftwood, plastic bags or fishing nets) that are inhaled during the voyage from entering the diversion channel 38, thereby reducing the situation where the aforementioned large debris is entangled in the impeller 76.

What is claimed is:

1. A built-in propulsion system, comprising:

an engine;

a diversion unit comprising a diversion base and an exhaust pipe, said diversion base being located at a bottom end of said engine, said diversion base comprising a water inlet located at a front end thereof, a water outlet located at an opposing rear end thereof, a diversion channel defined therein and having two opposite ends thereof respectively disposed in communication with said water inlet and said water outlet, a shaft hole and an exhaust chamber, said shaft hole being located above said water inlet and communicated with said diversion channel, said exhaust chamber being located behind said shaft hole, said exhaust pipe being provided with a top end fixed on an outer periphery of said diversion base in a way that said exhaust pipe is communication with said exhaust chamber of said diversion base; and a propulsion unit comprising a transmission shaft and an impeller connected to said transmission shaft, said transmission shaft being rotatably inserted through said shaft hole of said diversion base and connected to said engine, said impeller being located in said diversion channel of said diversion base above said water inlet of said diversion base;

wherein said diversion unit further comprises a reverse deflector pivotally connected to the rear end of said diversion base and biasable relative to said diversion base between a first position where said reverse deflector is located above said water outlet and a second position where said reverse deflector is located behind said water outlet;

wherein said reverse deflector comprises two lugs respectively located at opposing left and right sides thereof, said lugs having a respective front end thereof respectively pivoted to the rear end of said diversion base; said diversion unit further comprises a rocker and a link, said rocker being pivoted back and forth on the outer peripheral surface of said diversion base, said link having a front end thereof pivoted on a bottom end of said rocker and an opposing rear end thereof pivoted on a rear end of one said lug of said reverse deflector.

2. The built-in propulsion system as claimed in claim 1, wherein said water inlet has the opening thereof facing downward; said diversion unit further comprises a water inlet block located on a bottom surface of a front end of said diversion base below said water inlet, said water inlet block comprising a plurality of first diversion holes located on a front end thereof in communication with said water inlet and a plurality of second diversion holes located on a bottom surface thereof in communication with said water inlet.

3. The built-in propulsion system as claimed in claim 2, wherein said water inlet block comprises a plurality of arc-shaped deflectors arranged at intervals on the bottom surface thereof.

4. The built-in propulsion system as claimed in claim 1, wherein said diversion base further comprises a ring wall surrounding said impeller.

5. The built-in propulsion system as claimed in claim 1, wherein said diversion unit further comprises a tension spring, said tension spring having two opposite ends thereof respectively connected to said rocker and said reverse deflector.

6. The built-in propulsion system as claimed in claim 1, wherein said exhaust pipe has a bottom end thereof open downward.

7. The built-in propulsion system as claimed in claim 1, wherein said diversion channel extends spirally.

* * * * *